US006482351B2

(12) United States Patent
Kamikawa et al.

(10) Patent No.: US 6,482,351 B2
(45) Date of Patent: Nov. 19, 2002

(54) APPARATUS FOR PRODUCING REDUCED IRON

(75) Inventors: Susumu Kamikawa, Hiroshima (JP); Kouichi Hirata, Hiroshima (JP); Yoshimitsu Onaka, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/828,802

(22) Filed: Apr. 10, 2001

(65) Prior Publication Data

US 2002/0003324 A1 Jan. 10, 2002

(30) Foreign Application Priority Data

Jul. 5, 2000 (JP) ..... 2000-203529

(51) Int. Cl.[7] ..... C12B 13/14
(52) U.S. Cl. ..... 266/156; 266/160
(58) Field of Search ..... 266/144, 145, 266/155, 156, 160

(56) References Cited

U.S. PATENT DOCUMENTS 3,443,931 A * 5/1969 Beggs et al. ..... 75/503
5,076,838 A * 12/1991 Rierson ..... 75/479
5,364,441 A * 11/1994 Worner ..... 75/10.63
5,730,775 A * 3/1998 Meissner et al. ..... 75/484

FOREIGN PATENT DOCUMENTS

EP 0 275 863 A1 12/1987

* cited by examiner

*Primary Examiner*—Melvyn Andrews
(74) *Attorney, Agent, or Firm*—Birch, Stewart, Kolasch & Birch, LLP

(57) ABSTRACT

An apparatus for producing reduced iron dries agglomerates, pelletized from a powdery mixture of an iron oxide powder and a reducing agent, in a drying chamber, preheats the dried agglomerates in a preheating chamber, and then reduces the preheated agglomerates in a high temperature atmosphere of a reducing furnace. In the preheating chamber, an off-gas from the reducing furnace is convected to preheat the dried agglomerates. A decrease in the fuel cost, and downsizing of the equipment can be achieved by effective use of the sensible heat of the off-gas discharged from the reducing furnace. Moreover, a downsized, simplified system for treatment of the off-gas is realized by decreasing the amount of the off-gas.

9 Claims, 6 Drawing Sheets

APPARATUS FOR PRODUCING REDUCED IRON

The entire disclosure of Japanese Patent Application No. 2000-203529 filed on Jul. 5, 2000 including specification, claims, drawings and summary is incorporated herein by reference in its entirety.

BACKGROUND OF THE INVENTION

1. Field of the Invention

The present invention relates to an apparatus for producing reduced iron by reducing pellets or briquette-like agglomerates, formed from a powdery mixture of an iron oxide powder and a reducing agent, in a high temperature atmosphere.

2. Description of the Related Art

To produce reduced iron, the first step is, generally, to mix a powder of iron ore (iron oxide), a powder of coal (reducing agent), a powder of limestone (fluxing agent), and a binder such as bentonite, and to compress and pelletize the mixture to form wet balls called green balls. Then, the wet balls are dried to some degree to form dry balls. The dry balls are heated to a high temperature in a reducing furnace, where iron oxide in the iron ore is reduced with the coal as a reducing agent to form reduced iron in the form of pellets.

An example of a conventional apparatus for producing reduced iron is explained by way of FIG. 6. Powders of iron ore, coal, etc. and a binder are mixed in a mixer (not shown). The resulting mixed powder is pelletized in a pelletizer 001 to form green balls (raw pellets) GB. Then, the green balls GB are charged into a dryer 002, where they are dried with an off-gas from a reducing furnace 004 (to be described later on) to form dry balls DB. The dry balls DB are supplied to the reducing furnace 004 by a pellet feeder 003.

The interior of the reducing furnace 004 is maintained in a high temperature atmosphere upon heating by a burner 005, and an inside off-gas is discharged from an off-gas duct 006. Thus, the dry balls DB are preheated and heated with radiant heat from the wall of the furnace when they are passed through the interior of the reducing furnace 004. During their passage, the iron oxide in the iron ore is reduced with the coal as the reducing agent to form reduced iron in the form of pellets. The reduced pellets are discharged into a pellet discharger 008, and accommodated into a portable vessel 009.

The off-gas from the off-gas duct 006 usually contains some unburned gas, and is thus burned in an after burner chamber 007 nearly completely. Then, the off-gas is cooled in a water spray primary cooler 010, and then sent to a heat exchanger 011, where it undergoes heat exchange to heat combustion air. Combustion air heated by the heat exchange is sent to the reducing furnace 004, and fed into the furnace together with a fuel. On the other hand, the off-gas is cooled again in a secondary cooler 012, and part of it is sent to the dryer 002 as drying air for the green balls GB as stated earlier. All of the off-gas is then cleaned in a dust collector 013, and released into the atmosphere via a stack 014.

In the conventional apparatus for producing reduced iron, as described above, heat exchange is performed by the heat exchanger 011 between the off-gas discharged from the reducing furnace 004 and combustion air. The heated combustion air is supplied to the reducing furnace 004, where the dry balls DB are preheated and heated with radiant heat from the furnace wall. The temperature of the off-gas may be as high as about 1,300° C., so that the off-gas has a great amount of thermal energy. Conversely, the metallic recuperative heat exchanger 011 is thermally resistant to temperatures of about 900° C. or lower because of its structure. Thus, the off-gas is cooled by the water spray primary cooler 010 before it is sent to the heat exchanger 011. The dryer 002 for the green balls GB has a structure designed only to perform drying of the green balls GB. To prevent rupture of the pellets, the gas for drying also needs to be cooled to about 300° C. or lower (desirably about 270° C.). To adjust the temperature of the off-gas from the recuperative heat exchanger 011, the water spray secondary cooler 012 is provided to add water into the off-gas and lower the temperature of the gas to be supplied to the dryer 002, by utilizing the heat of vaporization of water.

As described above, the secondary cooler 012 is also needed in addition to the water spray primary cooler 010, so that the system for treatment of the off-gas is complicated. Besides, the amount of the off-gas increases at least by the amount of the water sprays used. Thus, the treatment system for the off-gas is upsized. Moreover, the dry balls DB are preheated by the radiant heat with low thermal efficiency in the reducing furnace 004, and the latent heat of evaporation of the off-gas is taken away by the water spray. That is, much of the heat in the off-gas is wasted. For such reasons, recovery of the sensible heat possessed by the off-gas (i.e., effective use of the sensible heat) is insufficient. Hence, consumption of fuel used in the reducing furnace 004 is increased thereby raising the fuel cost, and the equipment (reducing furnace) is upsized.

SUMMARY OF THE INVENTION

The present invention has been proposed in light of these circumstances. It is an object of this invention to provide an apparatus for producing reduced iron, which can decrease the fuel cost and downsize the equipment by effective use of the sensible heat of the off-gas discharged from the reducing means, and which can downsize and simplify a system for treatment of the off-gas by decreasing the amount of the off-gas.

According to the present invention, as a means of attaining the above object, there is provided an apparatus for, producing reduced iron by drying agglomerates, which are pelletized from a powdery mixture of an iron oxide powder and a reducing agent, by a drying means; preheating the dried agglomerates by a preheating means; and then reducing the preheated agglomerates in a high temperature atmosphere of a reducing means, wherein the preheating means convects an off-gas from the reducing means to preheat the dried agglomerates. Thus, a decrease in the fuel cost, and a downsizing of the equipment can be achieved by the effective use of the sensible heat carried by the off-gas discharged from the reducing means. Moreover, a downsized, simplified system for treatment of the off-gas is realized by decreasing the amount of the off-gas.

In the apparatus for producing reduced iron, the drying means and the preheating means may be integrally formed as a drying preheater for drying and preheating a continuous flow of the agglomerates. Thus, the reducing means can be downsized, and the drying preheater can be made more compactly.

In the apparatus for producing reduced iron, a combustion means may be provided for burning any unburned gas in the merged off-gas, and part of the off-gas from the combustion means may be cooled with air and supplied to the drying means to dry the agglomerates. Thus, the unburned gas in the off-gas flowing in the off-gas circulation loop can be completely burned, and the temperature of the off-gas fed to the drying means can be lowered effectively.

In the apparatus for producing reduced iron, any unburned gas contained in the part of the off-gas discharged from the preheating means may be burned using part of the combustion air which is supplied to the reducing means, and then the part of the off-gas may be supplied to the drying means. Thus, the unburned gas can be burned effectively, and this is useful when dry distilled coal or the like is used as the reducing agent in the raw pellets.

In the apparatus for producing reduced iron, a regenerative heat exchanger may be provided for heating combustion air to be supplied to the reducing means. Thus, the amount of the off-gas and the fuel for heating of the reducing means can be further decreased overall.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Embodiments of the present invention will now be described in detail with reference to the accompanying drawings, which in no way limit the invention.

First Embodiment

Figure 1:
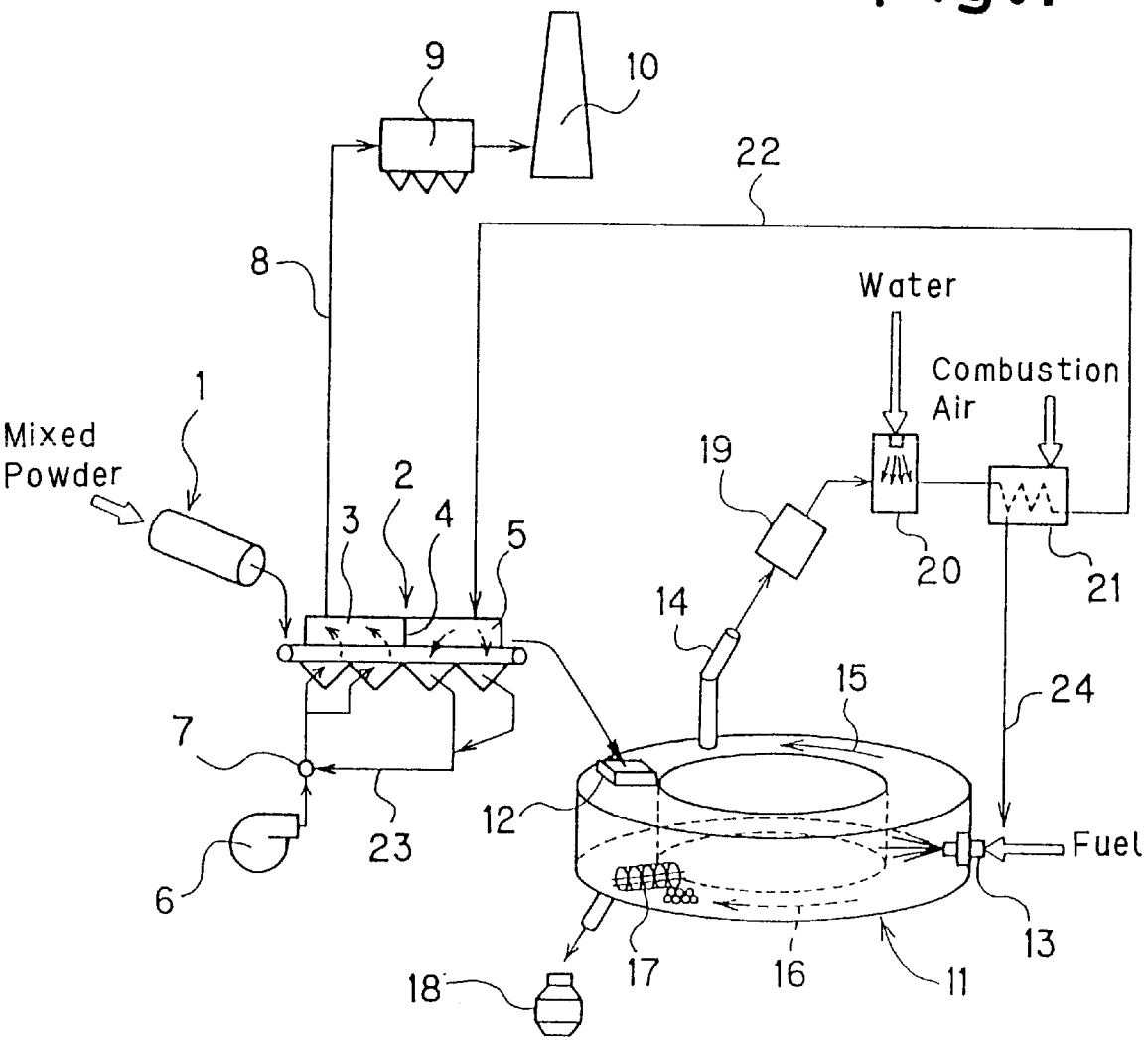
FIG. 1 is a schematic drawing of an apparatus for producing reduced iron, showing a first embodiment of the present invention.

FIG. 1 is a schematic drawing of an apparatus for producing reduced iron, showing a first embodiment of the present invention.

As shown in FIG. 1, a powder of iron ore (iron material), a carbonaceous powder (reducing agent) such as coal, and a powder of a flux such as limestone, which are materials for pellets, and if desired, a powder of a binder such as bentonite are mixed and kneaded in a mixer (not shown) with the addition of a predetermined amount of water to form a mixed powder. The mixed powder is pelletized in a pelletizer 1 to form green balls GB (raw pellets as agglomerates) of about 10 to 20 mm in diameter. These green balls GB are charged into a drying chamber (drying means) 3 constituting the first half of a drying preheater 2. In the drying chamber 3, the green balls GB are dried with a mixed gas to become dry balls DB. The mixed gas is a mixture of an off-gas from a preheating chamber (preheating means) 5, which is separated from the drying chamber 3 by a bulkhead 4 to constitute the latter half of the drying preheater 2, and room-temperature air which is introduced by an air blower 6. The off-gas and the room-temperature air are mixed in a gas merging portion 7, where the mixture is adjusted to a predetermined temperature (about 250° C. at which the green balls GB do not rupture). Then, the mixture is fed to the drying chamber 3 as the mixed gas. The gas discharged from the drying chamber 3 is guided by piping 8, treated by a gas cleaning device such as a dust collector 9, and then released into the atmosphere via a stack 10.

The dry balls DB are then fed to the preheating chamber 5 continuously by a conveyor or the like. In the preheating chamber 5, an off-gas from a rotary hearth reducing furnace (reducing means) 11 (to be described later on) is passed over the dry balls DB (convected for heat transfer) to preheat the dry balls DB to about 450° C. The dry balls DB preheated to about 450° C. are then supplied to the reducing furnace 11 by a pellet feeder 12.

A burner (group) 13 is mounted in the reducing furnace 11 to heat and maintain its interior in a high temperature atmosphere, and an off-gas can be discharged from an off-gas duct 14 (see the arrow 15 showing the direction of gas flow). Thus, when the dry balls DB move inside the reducing furnace 11 (see the arrow 16 showing the direction of hearth rotation), they are heated to a high temperature, and the iron oxide powder is reduced by the carbonaceous powder inside the pellets, whereby the pellet-shaped iron oxide can be formed. The reduced pellets (reduced iron pellets) are carried out of the reducing furnace 11 by a screw conveyor type of pellet discharger 17, accommodated into a portable vessel 18, and transported to a subsequent step.

On the other hand, the off-gas which is at a high temperature (1200 to 1300° C.) is discharged from the off-gas duct 14 and is sent to an after burner chamber 19, where any unburned gas, such as CO gas, in the off-gas is completely burned. Then, the off-gas is sent to a water spray gas cooler 20, where it is cooled to about 900° C. Then, the off-gas is sent to a recuperative heat exchanger 21, where the off-gas exchanges heat with combustion air for the reducing furnace heating burner 13 as stated above. Then, the off-gas is guided into the preheating chamber 5 of the aforementioned drying preheater 2 via piping 22. The gas temperature at the inlet of the preheating chamber 5 is about 570° C. The dry balls DB after drying are preheated to about 450° C., discharged from the preheating chamber 5, and charged into the aforementioned reducing furnace 11. On the other hand, the off-gas, which has finished preheating of the dry balls DB, reaches about 360° C., and exits from the preheating chamber 5. Then, the off-gas is sent to the aforementioned gas merging portion 7 via piping 23. On the other hand, the combustion air, which has been preheated to about 450° C. in the recuperative heat exchanger 21, is guided to the burner 13 via piping 24 for use as the combustion air for heating the reducing furnace 11.

Figure 6:
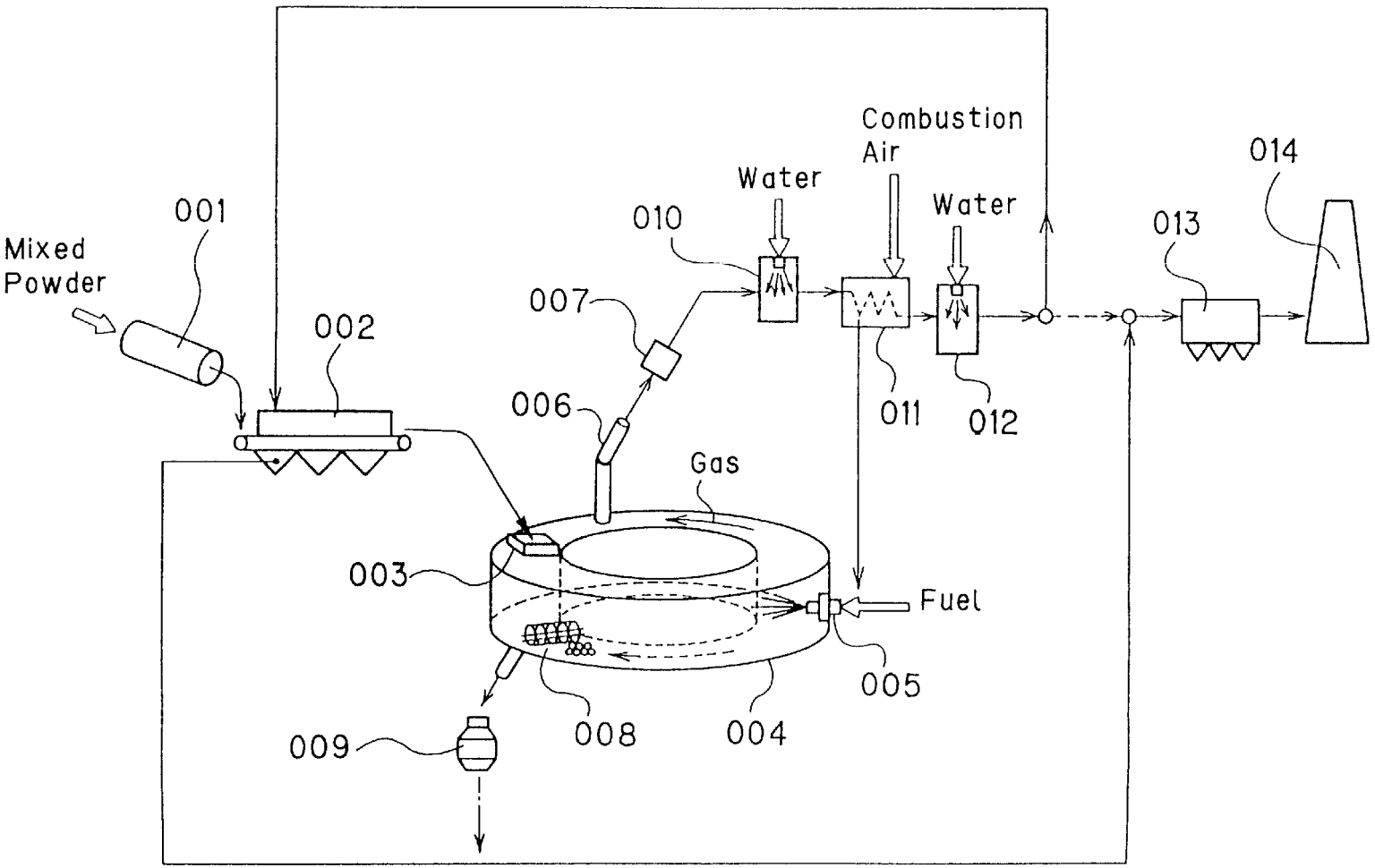
Fig.6 Related Art
FIG. 6 is a schematic drawing of a conventional apparatus for producing reduced iron.

According to the present embodiment, as described above, the convection type preheating chamber 5 is provided as the latter half of the drying chamber 3 for drying the green balls GB. The off-gas from the recuperative heat exchanger 21 is directly fed to the preheating chamber 5 to preheat the dried pellets (dry balls DB) efficiently to about 450° C. Thus, the carry-in energy (sensible heat) of the pellets when charged into the reducing furnace 11 increases, so that the fuel used by the burner (group) 13 can be decreased, on a natural gas basis, by about 30 $Nm^3$ (220 $Nm^3$ minus 190 $Nm^3$) per ton of reduced iron. In addition to the efficient preheating of the pellets by convective heat transfer in the preheating chamber 5 outside the reducing furnace 11, the drying means and preheating means are integrally formed as the drying preheater 2, whereby drying and preheating are performed for a continuous flow of the pellets. Thus, the reducing furnace 11 can be downsized, and compactness of the drying preheater 2 can be achieved. Furthermore, the off-gas discharged from the preheating chamber 5 is mixed with and cooled with air introduced by the air blower 6. Therefore, a conventional water spray secondary cooler 012 (see FIG. 6) becomes unnecessary. As a result, the loss of the latent heat of evaporation of the off-gas is prevented to improve thermal efficiency further. Besides, a decrease in the amount of the off-gas results in the downsizing and simplification of the off-gas treatment system.

Second Embodiment

Figure 2:
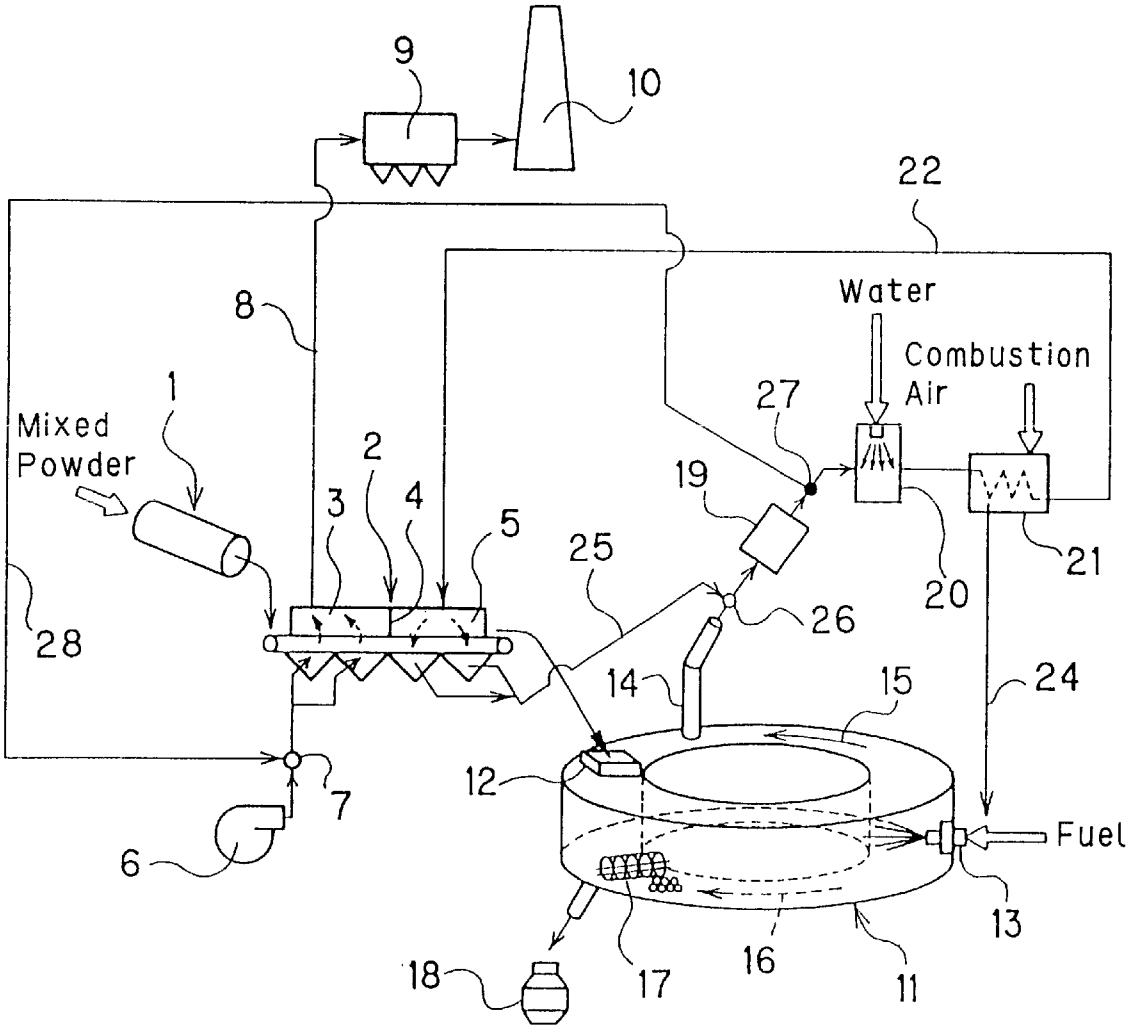
FIG. 2 is a schematic drawing of an apparatus for producing reduced iron, showing a second embodiment of the present invention.

FIG. 2 is a schematic drawing of an apparatus for producing reduced iron, showing a second embodiment of the present invention. In the present embodiment, the preheating chamber 5 of the drying preheater 2 and the off-gas duct 14 upstream of the after burner chamber 19 are connected together by piping 25 so that the off-gas discharged from the preheating chamber 5 is merged with the off-gas from the reducing furnace 11 at a gas merging portion 26, and the aforementioned piping 22, piping 25, etc. constitute an off-gas circulation loop.

Furthermore, piping 28 is branched from the off-gas duct 14 downstream of the after burner chamber 19, so that the off-gas having any unburned gas, such as CO gas, is completely burned by the after burner chamber 19 and then is partly branched at a gas branching portion 27, and is guided to the drying chamber 3 of the drying preheater 2. In this state, the temperature of the off-gas may be as high as about 950° C. Like the First Embodiment, therefore, the off-gas is mixed, at the gas merging portion 7, with room-temperature air introduced by the air blower 6. Consequently, the off-gas is adjusted to about 250° C., a temperature at which the green balls GB do not rupture.

Other features are the same as in the First Embodiment. Thus, the same members as in the First Embodiment will be assigned the same numerals, and duplicate explanations will be omitted.

In the present embodiment, the same actions and effects as in the First Embodiment are obtained. In the present embodiment, moreover, part (40 to 70%) of the off-gas discharged from the after burner chamber 19 is branched, and directly allocated to drying of the green balls GB. Thus, drying of the green balls GB is efficiently performed, and the amount of the gas passing through the recuperative heat exchanger 21, which is restricted by the gas temperature at the inlet, can be decreased to about a half or less of the conventional amount of the gas. Hence, the amount of water spray in the water spray gas cooler 20 provided ahead of the recuperative heat exchanger 21 can be cut down. As a result, the final amount of the off-gas discharged from the stack 10 can be decreased by about 500 $Nm^3$ (1800 $Nm^3$ minus 1300 $Nm^3$) per ton of reduced iron in comparison with the conventional apparatus.

Third Embodiment

Figure 3:
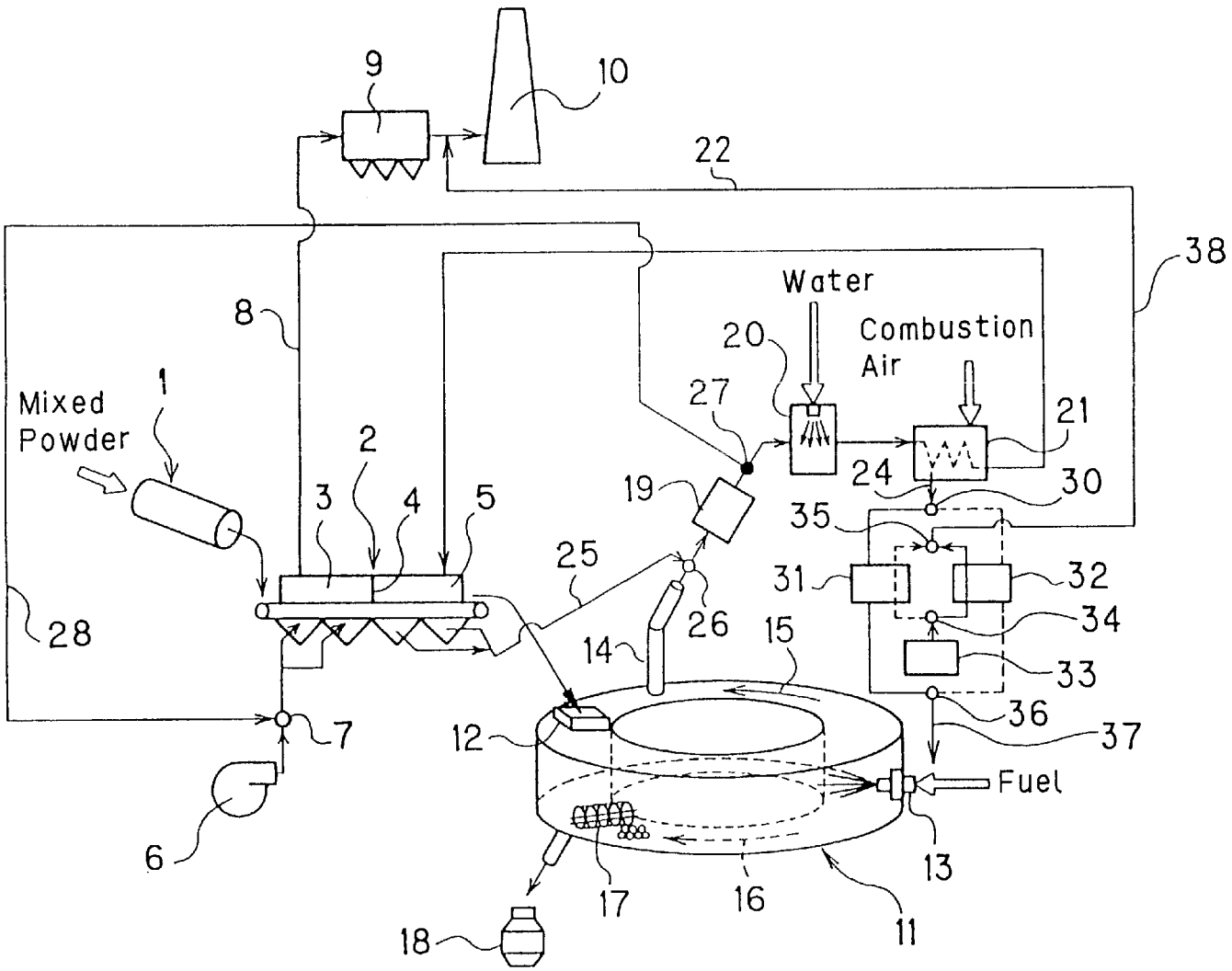
FIG. 3 is a schematic drawing of an apparatus for producing reduced iron, showing a third embodiment of the present invention.

FIG. 3 is a schematic drawing of an apparatus for producing reduced iron, showing a third embodiment of the present invention. In the present embodiment, the temperature of the combustion air for the reducing furnace which is preheated by the recuperative heat exchanger 21 as in the preceding Second Embodiment is raised to about 1,000° C. with the use of a regenerative heat exchanger. That is, in FIG. 3, the reference numerals 31 and 32 each denote a regenerative heat exchanger. These heat exchangers 31 and 32 are alternately heated with a high temperature combustion gas sent from a burner chamber 33. The numerals 30 and 36 denote flow selector valves for the preheated combustion air. The numerals 34 and 35 denote flow selector valves for a high temperature combustion gas for the heat exchangers 31, 32.

In FIG. 3, solid lines show a state currently in use, while dashed lines show a state after flow selection. That is, combustion air is preheated to about 450° C. in the recuperative heat exchanger 21, then passes through piping 24, and enters the heat exchanger 31 via the flow selector valve 30. In the heat exchanger 31, the combustion air is preheated to about 1,000° C., then passes through the flow selector valve 36, and finds use as combustion air for heating the reducing furnace 11 after flowing in piping 37. On the other hand, a high temperature combustion gas at about 1,500° C. produced by burning a natural gas or the like with air in the burner chamber 33 is guided to the other heat exchanger 32 via the flow selector valve 34 to heat (regenerate) the heat exchanger 32. Then, the gas is discharged from the heat exchanger 32 as a low temperature off-gas of about 150° C., sent to the stack 10 via the flow selector valve 35 and piping 38, and released into the atmosphere.

Other features are the same as in the Second Embodiment. Thus, the same members as in the Second Embodiment will be assigned the same numerals, and duplicate explanations will be omitted.

In the present embodiment as well, the same actions and effects as in the Second Embodiment are obtained. In the present embodiment, moreover, the preheating temperature of combustion air for the reducing furnace can be raised from about 450° C. in the Second Embodiment to as high as about 1,000° C. Thus, the overall amount of off-gas can be decreased by about 600 $Nm^3$ (1800 $Nm^3$ minus 1200 $Nm^3$) per ton of reduced iron. Also, fuel for heating of the reducing furnace can be decreased by about 40 $Nm^3$ (220 $Nm^3$ minus 180 $Nm^3$) when a natural gas is used.

Fourth Embodiment

Figure 4:
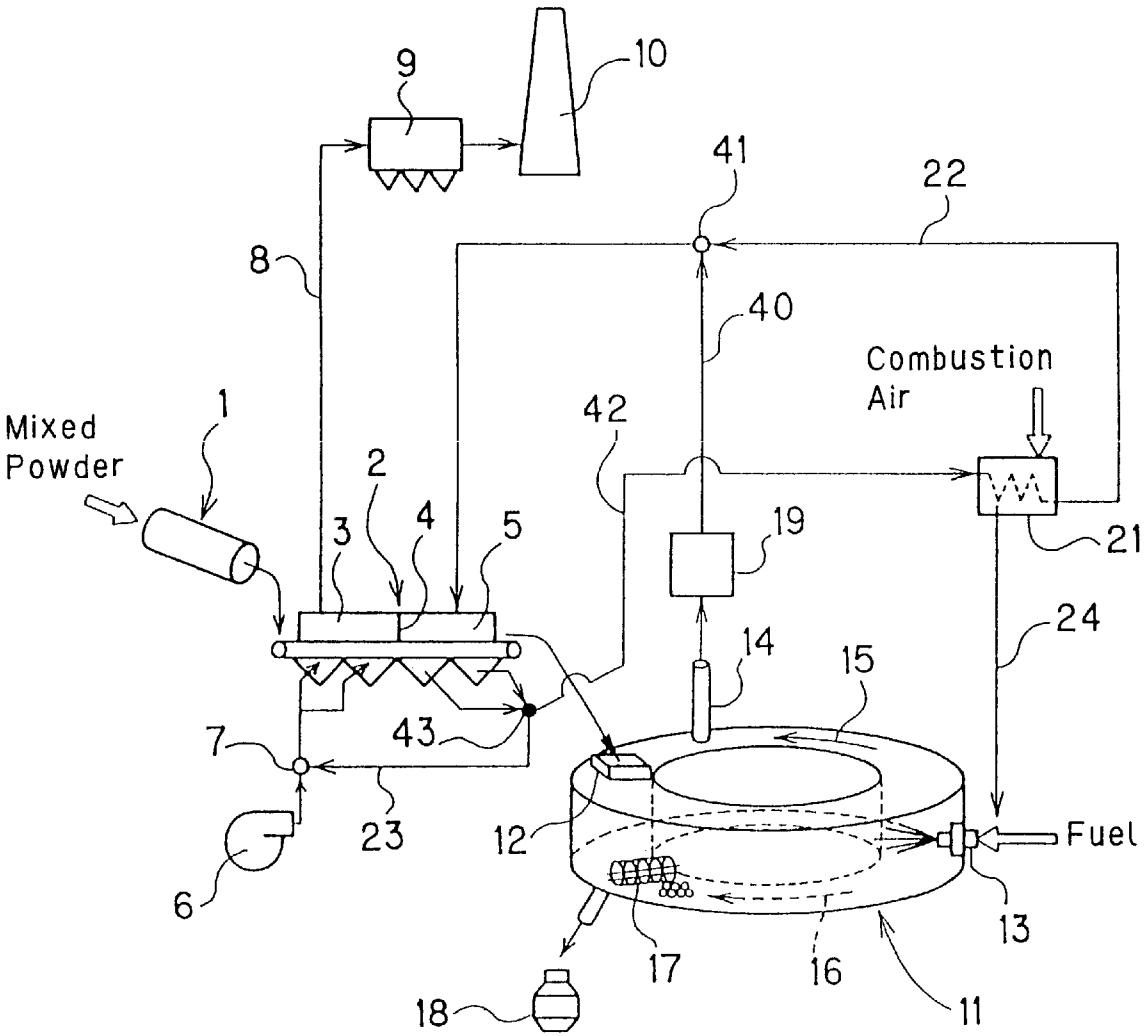
FIG. 4 is a schematic drawing of an apparatus for producing reduced iron, showing a fourth embodiment of the present invention.

FIG. 4 is a schematic drawing of an apparatus for producing reduced iron, showing a fourth embodiment of the present invention. In the present embodiment, piping 40 from the after burner chamber 19 is connected to a site midway through the piping 22 connecting the recuperative heat exchanger 21 and the preheating chamber 5 of the drying preheater 2 in the aforementioned First Embodiment. Furthermore, piping 42 branched from the piping 23 connecting the preheating chamber 5 (its wind box) and the gas merging portion 7 is directly connected to the recuperative heat exchanger 21. In this manner, an off-gas circulation loop is formed from the piping 22, piping 42, etc. Other features are the same as in the First Embodiment. Thus, the same members as in the First Embodiment will be assigned the same numerals, and duplicate explanations will be omitted.

According to the above configuration, an off-gas discharged from the off-gas duct 14 is sent to the after burner chamber 19, where any unburned gas, such as CO gas, in the off-gas is completely burned. Then, the off-gas is fed to the preheating chamber 5 via the piping 40 and a gas merging portion 41. The temperature of the off-gas which has just left the after burner chamber 19 may be as high as about 1,200° C. or above. Thus, the off-gas is mixed and diluted, at the gas merging portion 41, with a circulating off-gas which is fed from the recuperative heat exchanger 21 via the piping 22. The mixed gas is adjusted to a temperature of about 750 to 800° C., and fed in this state to the preheating chamber 5. Pellets are preheated with this gas to about 750° C., and discharged from the preheating chamber 5.

The off-gas, which has finished preheating of the pellets, cools to about 640° C., and is discharged from the preheating chamber 5. Then, the off-gas is sent again to the recuperative heat exchanger 21 via the piping 42. In the heat exchanger 21, the off-gas exchanges heat with combustion air for the reducing furnace heating burner 13, and is then circulated via the piping 22 for reuse in preheating of pellets. The temperature of the circulating off-gas at the outlet of the recuperative heat exchanger 21 is about 430° C.

On the other hand, the off-gas discharged from the preheating chamber 5 is partly branched at a gas branching portion 43, and is guided to the drying chamber 3 via the piping 23. In this state, the temperature of the off-gas at the inlet of the drying chamber may be as high as about 640° C. as stated above. Like the First Embodiment, therefore, the off-gas is mixed, at the gas merging portion 7, with room-temperature air introduced by the air blower 6. Consequently, the off-gas is adjusted to about 250° C., a temperature at which the green balls GB do not rupture.

In the present embodiment, like the First Embodiment, the pellets after drying are subsequently preheated to about 750° C. with high efficiency. As the carry-in energy (sensible heat) of the pellets when charged into the reducing furnace 11 increases, the fuel used by the reducing furnace heating burner 13 can be decreased, on a natural gas basis, by about 50 $Nm^3$ (220 $Nm^3$ minus 170 $Nm^3$) per ton of a reduced iron product. In the present embodiment, moreover, the off-gas after preheating of the pellets is discharged at a low temperature of about 640° C. Thus, this gas can be directly fed, unchanged, to the recuperative heat exchanger 21, and the off-gas that has left the recuperative heat exchanger 21 may have a high temperature, since it is fed to the preheating chamber 5. These advantages make it unnecessary to provide a water spray cooler immediately behind the recuperative heat exchanger 21, as was done in the conventional example. Hence, there is no problem of the amount of the off-gas increasing with the use of a water spray. Compared with the conventional example, therefore, the final amount of the off-gas can be decreased by about 800 $Nm^3$ (1800 $Nm^3$ minus 1000 $Nm^3$) per ton of reduced iron.

In addition, the present embodiment can be applied when preparing raw pellets mainly from ironwork dust occurring in ironworks, etc., and drying, preheating and reducing the pellets. The ironwork dust already contains a carbonaceous powder scant in volatiles as a reducing agent. Thus, when the pellets are preheated at a high temperature, few volatiles are contained in the off-gas from the preheating chamber 5.

Fifth Embodiment

Figure 5:
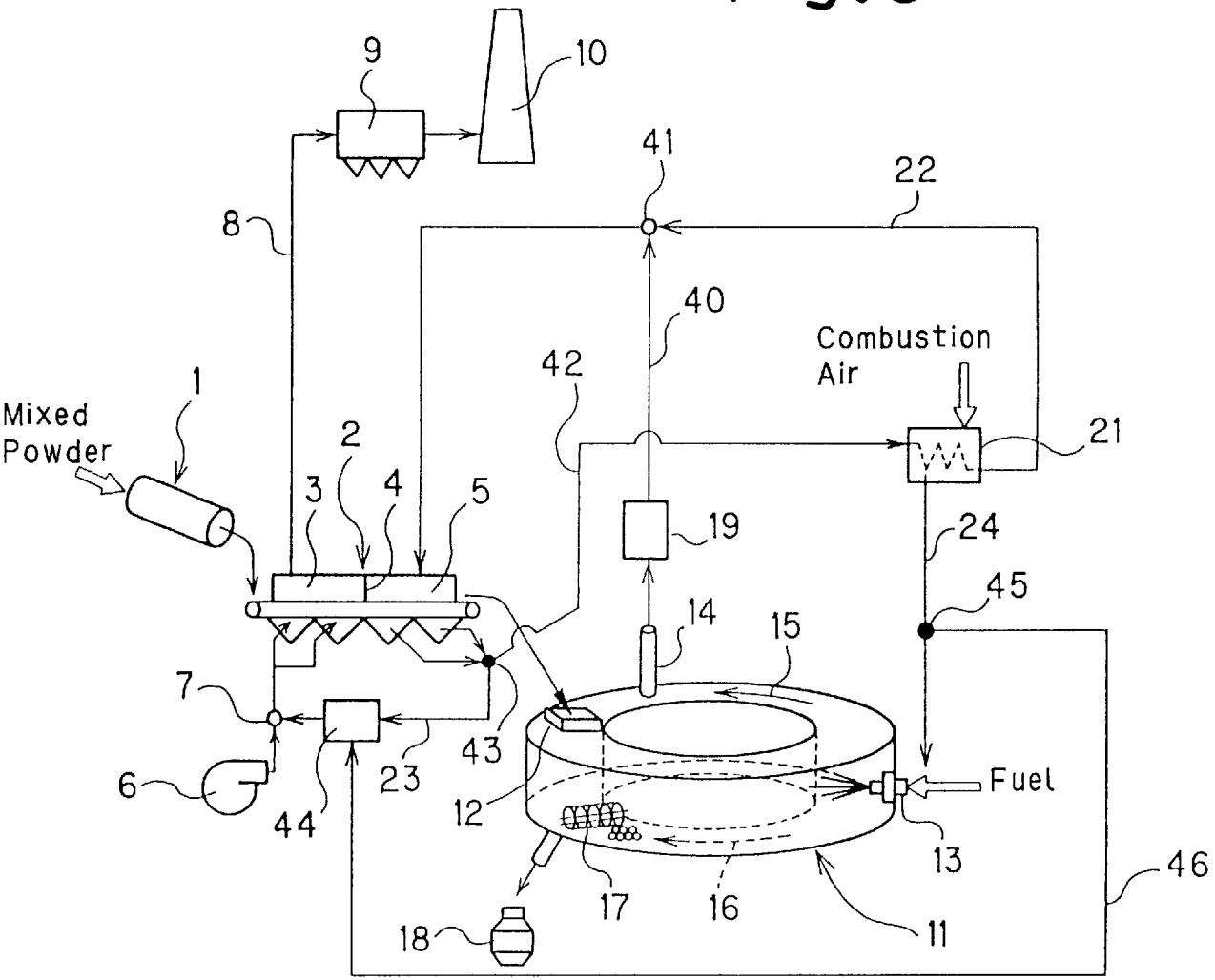
FIG. 5 is a schematic drawing of an apparatus for producing reduced iron, showing a fifth embodiment of the present invention.

FIG. 5 is a schematic drawing of an apparatus for producing reduced iron, showing a fifth embodiment of the present invention. The present embodiment is a modification of the Fourth Embodiment which uses dry distilled coal as a reducing agent for raw pellets. In FIG. 5, the same members as in FIG. 4 illustrating the Fourth Embodiment will be assigned the same numerals, and duplicate explanations will be omitted.

As the pellets are preheated at a high temperature (about 750° C.) in the preheating chamber 5, the off-gas discharged from the preheating chamber 5 (its wind box), no doubt, contains volatiles (combustible gas). Thus, part of the off-gas from the preheating chamber 5 is guided to an after burner chamber 44 via the gas branching portion 43 and piping 23, as shown in FIG. 5. In the after burner chamber 44, unburned matter (combustible gas) contained in the off-gas is burned. Air for this burning is obtained in the following manner: Combustion air for the reducing furnace heating burner 13 is preheated to about 450° C. in the recuperative heat exchanger 21, and branched at a gas branching portion 45. The branched air passes through piping 46, and is introduced into the after burner chamber 44, where it is used as the above-mentioned air for combustion of the unburned matter. The off-gas having the unburned matter completely burned is mixed and diluted, at the gas merging portion 7, with room-temperature air introduced by the air blower 6. As a result, the mixed gas is adjusted to a gas temperature of about 250° C. Then, the gas is fed into the drying chamber 3 to dry the raw pellets. The gas discharged from the drying chamber 3 is guided by piping 8, treated by a gas cleaning device such as dust collector 9, and then released into the atmosphere via the stack 10.

In the present embodiment, like the Fourth Embodiment, the pellets after drying are subsequently preheated to about 750° C. with high efficiency. As the carry-in energy (sensible heat) of the pellets when charged into the reducing furnace 11 increases, the fuel used by the reducing furnace heating burner 13 can be decreased, on a natural gas basis, by about 50 $Nm^3$ (220 $Nm^3$ minus 170 $Nm^3$) per ton of a reduced iron product. Furthermore, like the Fourth Embodiment, water spray is not introduced for cooling of the off-gas from the reducing furnace 11. Thus, compared with the conventional example, the final amount of the off-gas discharged from the stack 10 can be decreased by about 650 $Nm^3$ (1800 $Nm^3$ minus 1150 $Nm^3$) per ton of a reduced iron product.

The present invention being thus described, it will be obvious that the same is not limited to the foregoing embodiments, but may be varied in many ways. For example, the embodiments have been illustrated, with the agglomerates of the materials for reduction being restricted to pellets. However, the invention can be applied similarly to briquettes as the agglomerates. Furthermore, in the First, Second, Fourth and Fifth Embodiments, the temperature of combustion air for the reducing furnace may be raised with the use of a regenerative heat exchanger. Such variations are not to be regarded as a departure from the spirit and scope of the invention, and all such modifications as would be obvious to one skilled in the art are intended to be included within the scope of the following claims.

What is claimed is:

1. An apparatus for producing reduced iron, comprising:

means for drying agglomerates which are formed from a powdery mixture comprising an iron oxide powder and a reducing agent;

means for preheating the dried agglomerates;

reducing means for reducing the preheated agglomerates in a high temperature atmosphere to form reduced iron pellets and an off-gas; and an off-gas circulation loop which exhausts the off-gas from the reducing means, provides off-gas to each of the means for drying and means for preheating, and merges the off-gas from the reducing means with off-gas from the means for preheating whereby the heat contained in the off-gas exhausted from the reducing means is dissipated partially in the means for drying and means for preheating such that the apparatus for producing reduced iron apparatus with increased efficiency.

2. The apparatus for producing reduced iron as claimed in claim 1, wherein the drying means and the preheating means are integrally formed as a drying preheater for drying and preheating a continuous flow of the agglomerates.

3. The apparatus for producing reduced iron as claimed in claim 1, wherein combustion means is provided for burning any unburned gas in the merged off-gas, and a part of the off-gas from the combustion means is cooled with air and supplied to the means for drying to dry the agglomerates.

4. The apparatus for producing reduced iron as claimed in claim 1, wherein a part of the off-gas discharged from the means for preheating is cooled with air and supplied to the means for drying to dry the agglomerates.

5. The apparatus for producing reduced iron as claimed in claim 4, wherein there is further provided a means for providing combustion air to the reducing means, and any unburned gas contained in the part of the off-gas discharged from the means for preheating is burned in a combustion means using a part of the combustion air supplied to the reducing means, and then the part of the off-gas is supplied to the means for drying.

6. The apparatus for producing reduced iron as claimed in claim 1, wherein a regenerative heat exchanger is provided for heating combustion air to be supplied to the reducing means.

7. An apparatus for producing reduced iron as claimed in claim 6, wherein the off-gas circulation loop includes the regenerative heat exchanger and a means for merging off-gas from the reducing means with air for supplying to the means for drying.

8. An apparatus for producing reduced iron as claimed in claim 7, wherein means are provided for exhausting off-gas from the means for drying to the atmosphere.

9. An apparatus for producing reduced iron as claimed in either claim 4 or claim 5, wherein there is further provided a regenerative heat exchanger for heating combustion air to be supplied to the reducing means.

* * * * *